United States Patent [19]

Wilson

[11] 4,288,320

[45] Sep. 8, 1981

[54] VIBRATING SCREEN WITH SCREEN DECK UNCLOGGING MECHANISM

[75] Inventor: Albert Wilson, Columbia, S.C.

[73] Assignee: Litton Systems, Inc., Columbia, S.C.

[21] Appl. No.: 146,251

[22] Filed: May 5, 1980

[51] Int. Cl.[3] ..... B07B 1/54

[52] U.S. Cl. ..... 209/382; 209/403

[58] Field of Search ..... 209/381, 382, 395, 400, 209/403; 210/407, 408, 413; 55/293, 300

[56] References Cited

U.S. PATENT DOCUMENTS

| | | | |
|---|---|---|---|
| 711,133 | 10/1902 | Snyder | 209/382 |
| 2,014,128 | 9/1935 | Deister et al. | 209/382 |
| 3,070,230 | 12/1962 | Peterson | 209/382 X |
| 4,122,006 | 10/1978 | Christensen et al. | 209/382 |
| 4,169,788 | 10/1979 | Grunbaum | 209/382 X |

FOREIGN PATENT DOCUMENTS

| | | | |
|---|---|---|---|
| 12904 | of 1901 | United Kingdom | 209/382 |

*Primary Examiner*—William A. Cuchlinski, Jr.
*Attorney, Agent, or Firm*—Morris I. Pollack

[57] ABSTRACT

A plurality of weighted springy arms are formed integral with, and so as to extend laterally, to one or both sides of, a resilient mounting strip that is disposed beneath, and in contact with, the lower surface of the screen deck of a vibrating screen. The intended vibrating action of the vibrating screen induces an oscillating movement of the weighted springy arms to effect a rapping action of the weighted ends of the arms against the undersurface of the screen deck to loosen material which may have lodged in or plugged the screen openings and to unclog same.

The resilient strips disposed on the extreme sides of the screen need only have weighted springy arms on the side thereof towards the central portion of the screen deck if space on the other side of the strip does not permit proper disposition and action of such an arm; while the strips disposed in the central section of the vibrating screen have arms extending from both sides of the resilient strip.

The springy arms, are either cast in suitable rubber or plastic; with either integral weighted ends or with apertures disposed at their ends to receive suitably sized weights, formed from metal or other material of appropriate weight characteristics. Alternatively the arms may be cast about a springy metal leaf to impart appropriate and desired spring characteristics to the arm to facilitate the coaction of the arm and screen deck and unclogging of the screen apertures.

34 Claims, 10 Drawing Figures

VIBRATING SCREEN WITH SCREEN DECK UNCLOGGING MECHANISM

BACKGROUND OF THE INVENTION

1. Field of Application

This invention relates to vibrating screens; and more particularly to vibrating screens with mechanisms for impacting against the underside of the screen deck to loosen and dislodge material which may have become stuck in the screen deck openings.

2. Description of the Prior Art

Vibrating screens are utilized to sift and separate bulk materials of varying characteristics for many applications. In general, these vibrating screens include a vibrating or live frame, suitably mounted on springs, and having a single screen deck, or a number of superimposed spaced screen decks. Each such screen deck is formed with an array of openings sized and spaced to provide the intended sorting and sifting of a type or types of bulk material. A vibrating mechanism is provided for vibrating the frame, screen decks, or decks, and bulk material, to effect the desired sifting and sorting.

Quite often the size or configuration of the apertures, and/or the nature of the bulk material to be sorted is such that the material tends to lodge in or clog up the screen openings. This is especially true for bulk material which may be wet due to processing requirements or inclement weather, or due to inherent sticky surface characteristics of the material.

Some available vibrating screens are equipped with screen unclogging or cleaning mechanisms which consist of a plurality of loose rubber balls disposed between the screen deck and a plate or tray positioned beneath the screen deck. However in such screens the requirement for the lower deck not only adds an additional cost but also provides a second and maybe unwanted level of screening that slows down the screening process. In addition in screens of the type shown in U.S. Pat. No. 2,946,440 of L. E. Simpson the balls have a tendency to migrate to one end of the apparatus when mounted at an angle as is often common for many vibrating screens; and thus to only provide the unclogging action at the lower most screen deck area. While in screens of the type shown in U.S. Pat. No. 2,269,289 of H. Schifflin et al the compartmentalization of the ball support deck, while acting to keep the balls positioned beneath the entire deck, should the screen be tilted, still displays a tendency for the balls to roll to the low end of each compartment, and necessitates the expenses of the compartmenting.

Other screens such as shown in U.S. Pat. No. 3,841,482 of J. B. Brown et al, and in U.S. Pat. No. 3,960,731 of L. K. Brandt, utilize a number of sliders of varying size and/or configuration disposed between the underside of the screen deck and a tray or deck positioned thereunder. Here again the slider support deck adds an extra cost and can interfere with the screening process. In addition the sliders tend to rub and abrade the underside of the screen deck and accelerate its wearing out and the cost of replacing same.

Another suggested approach to this problem entails the use of weighted elements supported for pendular type action beneath the screen deck. In mechanisms of this sort as suggested in U.S. Pat. No. 1,779,348 of A. W. Viehmann and in U.S. Pat. No. 3,070,230 of A. K. Peterson, the pivotal mounting of the weighted members is complicated and entails extra expense adding to the cost of the equipment; and is such that clogging of the pivotal mounting by the material being sorted will stop operation of unclogging mechanism. Those mechanisms which flex the screen to loosen clogged particles accelerate fatigue and cracking of the screen webs; while in those screens which merely allow the weighted ball to hang down below the screen support ribs, such as shown in U.S. Pat. No. 4,122,006 of E. Christensen et al, the relatively large arc of swing required for the ball may not be possible, or so reduces the impact force of the ball against the screen deck, as to render the unclogging action unsatisfactory.

SUMMARY OF THE INVENTION

It is therefore an object of this invention to provide a new and improved vibrating screen.

It is another object to provide a new and improved screen deck unclogging mechanism.

It is yet another object to provide a new and improved screen deck unclogging mechanism for a vibrating screen.

It is yet still another object to provide a new and improved mounting for a screen deck unclogging mechanism.

It is yet still a further object to provide a new and improved resiliant screen deck support strip with an integrally formed screen deck unclogging mechanism.

This invention involves vibrating screens contemplates forming screen deck support strips with springy arms weighted at the ends and disposed in an array beneath the screen deck so that the screen vibrating action induces a rapping of the weighted ends of the arms against the underside of the screen to loosen and unclog material which may have lodged or stuck in the screen openings.

Other objects, features, and advantages of the invention in its details of construction and arrangement of parts will be seen from the above, from the following description of the preferred embodiments when considered with the drawings and from the appended claims.

DESCRIPTION OF THE PREFERRED EMBODIMENT

For convenience the invention will be described as applied to a pedestal mounted vibrating screen, having a pair of spaced wire mesh screen decks, mounted in the live frame of the vibrating screen so as to assume a crowned condition, wherein the screen deck mounting is such that the screen decks are urged against resiliant strips running beneath the length of such decks; and wherein springy weighted arms are cast from rubber so as to extend to either one or both sides of such resiliant strips. It should be understood, nevertheless, that without departing from the scope of the invention that: the screen can be spring or otherwise mounted; that it can have a single deck or more than two decks; that the screen decks can be perforated plate, coated wire mesh or otherwise formed; that such screen decks can be positioned so as to be in a flat or other then crowned disposition; that such screen decks can be spaced form the strips carrying the springy arms as long as the weighted ends thereof are disposed to rap against the underside of the screen deck during vibrating of the screen; and that the springy arms can be formed of plastic or other suitable material.

Figure 1:
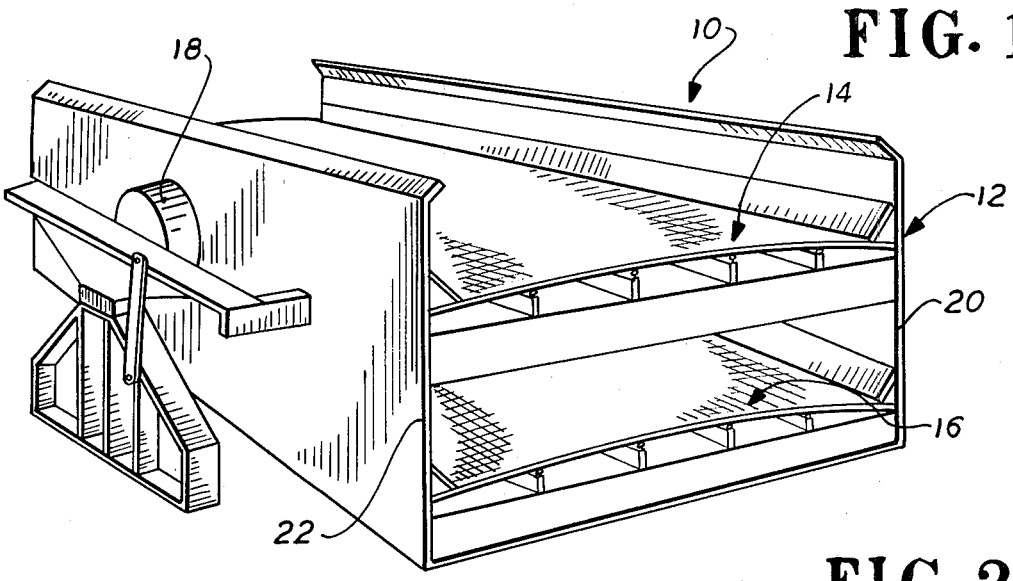
FIG. 1 is a perspective showing of a vibrating screen incorporating the instant invention.
Figure 2:
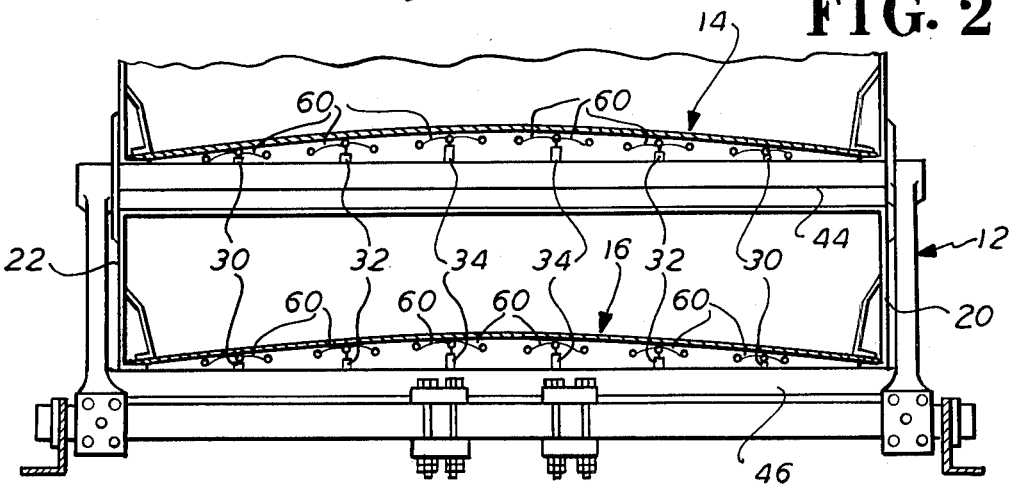
FIG. 2 is a sectional view of the vibrating screen of FIG. 1.

With reference to FIGS. 1 and 2 there is generally shown at 10 a vibrating screen having a vibrating or live frame 12, a pair of spaced screen decks 14, 16 and a vibrating mechanism 18. Live frame 12, screen decks 14, 16, and vibrating mechanism 18 are of conventional construction such that when connected to a suitable drive means and with appropriate controls vibrating mechanism 18 will induce a predetermined vibration in live frame 12 and in screen decks 14, 16 to effect sifting and sorting of bulk material deposited on upper deck 14.

Screen decks 14, 16 are each of conventional wire mesh construction, and may each consist of a single screen panel sized to the width and length of vibrating screen 12, or two or more screen panels sized to the width of vibrating screen 10 but of a length such that the selected number of such panels is appropriate for the length of vibrating screen 10.

Each screen deck 14, 16 is mounted between side plates 20, 22 (FIG. 2) of live frame 12 so as to be urged down against a plurality of screen deck support assemblies 30, 32 and 34. Support assemblies 30, 32, 34 increase in height as they are positioned towards the center of screen 10 so that when the screen panels making up screen decks 14, 16 are secured in place in live frame 12 (by conventional securing mechanisms not shown) screen decks 14,16 are maintained in a crowned condition as shown in FIGS. 1 and 2. If desired, however, support assemblies 30–34 may be of identical height and then screen decks 14,16 will lie in a horizontal plane when so secured in screen 10.

Figure 5:
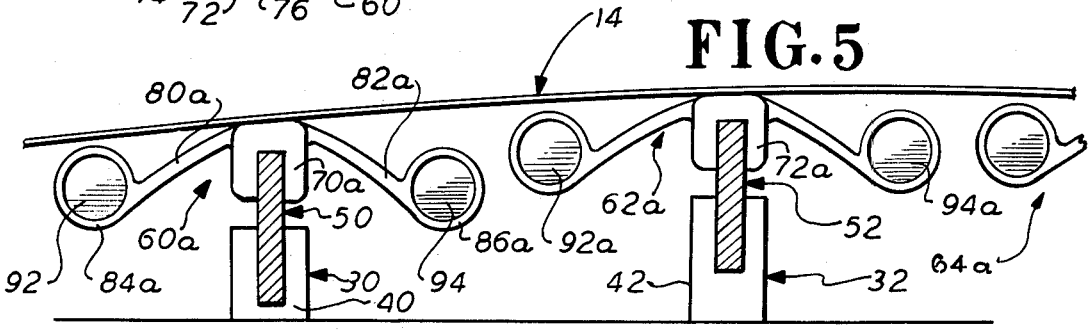
FIG. 5 is an enlarged elevational view, partly in section, of a portion of one screen deck of the screen of FIGS. 1 and 2 shoving the rapping arms positioned therebeneath.

Each support assembly 30,32,34 is of substantially identical construction, but may differ only in height, so the following description of support assemblies 30, 32, for screen deck 14, shown in FIG. 5 should be sufficient to cover all.

Base unit 40, 42 of each support assembly, are secured by suitable means such as welding to cross braces 44,46 (FIG. 2) disposed between side plated 20, 22 of live frame 12. Support bars 50, 52 are secured, as by welding in base units 40, 42 respectively. Each support bar 50, 52 extends substantially the length of live frame 12.

Figure 3:
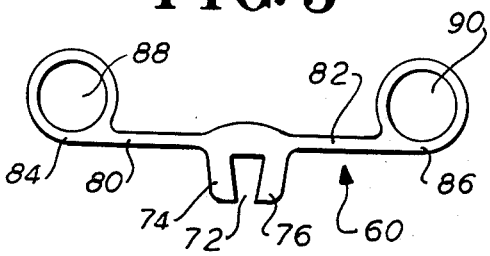
FIG. 3 is a elevational view of an individual rapping arm utilized on the screen of FIGS. 1 and 2.
Figure 4:
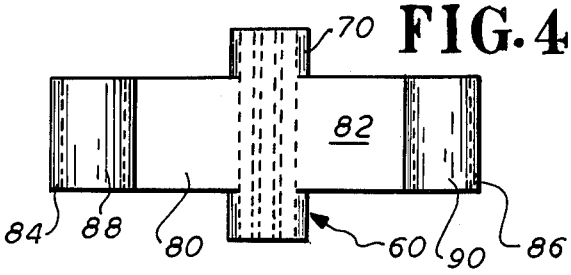
FIG. 4 is a plan view of the rapping arm of FIG. 3.

A plurality of individual rapping arm assemblies 60*a*, 60*b*, 60*c*, 62*a*, 62*b*, 62*c*, etc. (FIGS. 3–6) are disposed on top of support bars 50, 52 respectively. All of such rapping arm assemblies 60*a*,60*b*.62*a*,62*b*, etc are identical in construction so only rapping arm 60 (FIGS. 3 and 4) will be described in detail. Each rapping arm is formed of cast rubber of suitable resiliant characteristics. An appropriate plastic will also serve the purpose. Each such rapping arm includes a resiliant mounting strip portion 70 formed with a longitudinal groove 72 (FIG. 4) having side walls 74,76 which at their free ends tend to be urged towards each other so that when rapping arm assembly is positioned atop its respective support bar (50,52 etc.) it will grip the sides thereof and be securely held in position thereon.

Figure 7:
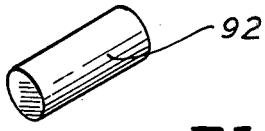
FIG. 7 is a perspective view of the weight used with the rapping arms of FIGS. 3–7.
Figure 6:
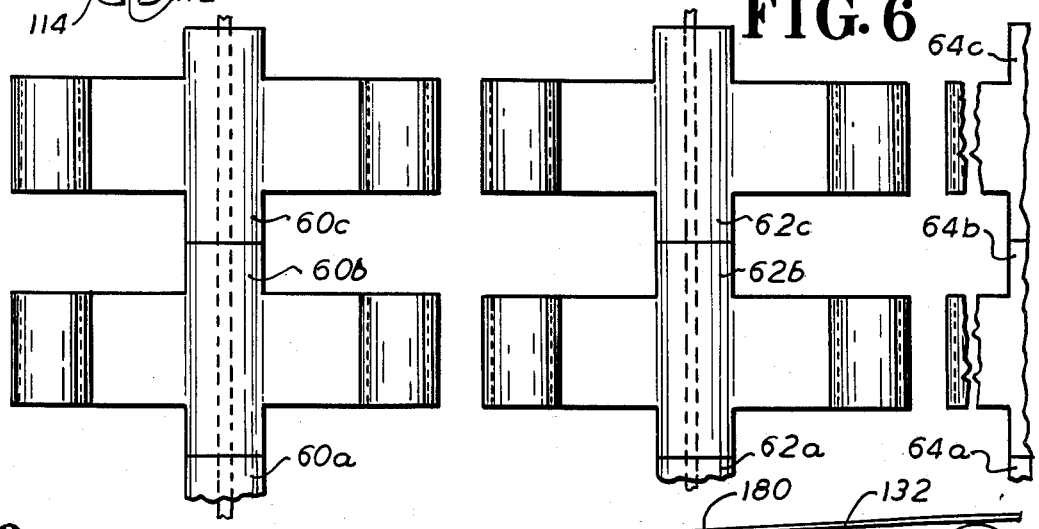
FIG. 6 is a plan view of the array of rapping arms disposed as shown in FIG. 5.

A springy arm 80,82 extends to each side of resiliant strip 70, each such arm 80,82 respectively terminating in a free end 84,86 each formed with an aperture 88,90. A cylindrical weight 92,94 (FIGS. 5 and 7) is disposed in apertures 88,90 respectively to be held securely therein. This is accomplished by forming weights 92,94 by casting, or other suitable process, so that the outside diameters thereof are sized to provide a snug and secure fit with the inside surface of apertures 88,90.

If desired rapping arm assemblies 60, disposed proximate the left or right sides of live frame 12, may be formed so that they have springy arms 80,82 extending only to one side thereof to avoid interference between a side plate 20,22 of live frame 12 and a springy arm 80,82 extending to the other side thereof. Rapping arm assemblies 60 may be disposed along the entire length of support bars 50,52, or, if suitable, a resiliant strip, corresponding to strip portion 70 of such rapping arm assemblies 60, may be spaced between a selected disposition of rapping arm assemblies 60.

When so arranged beneath screen decks 14,16 rapping arm assemblies 60 will be vibrated along with screen decks 14,16 and the weighted ends thereof will rap against the underside of screen decks 14,16 to loosen any material that may be lodged or otherwise stuck in the screen openings and be so doing unclog the screen decks 14,16.

Figure 8:
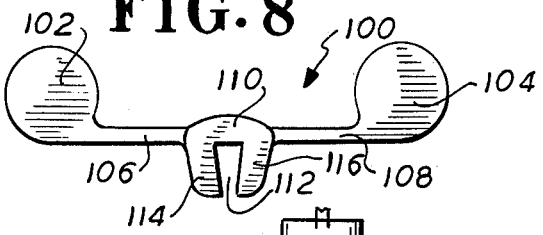
FIG. 8 is an alternative embodiment of a rapping arm.

A modified rapping arm assembly 100 (FIG. 8) is formed by casting rubber, plastic, or other suitable material with solid free ends 102,104 for the springy arms 106,108 which extend respectively to each side of the resiliant strip portion 110 thereof. A central groove 112, provided in rapping arm assembly 100 by way of side walls 114,116, is formed therein so as to facilitate positioning of rapping arm assembly on support bars 50,52. The solid free ends 102,104 of rapping arm assemblies 100 are sized, of a configuration, and formed from appropriate material so that the concentrated weight thereof provides the appropriate rapping action against the underside of the screen deck when the screen is vibrated.

Figure 9:
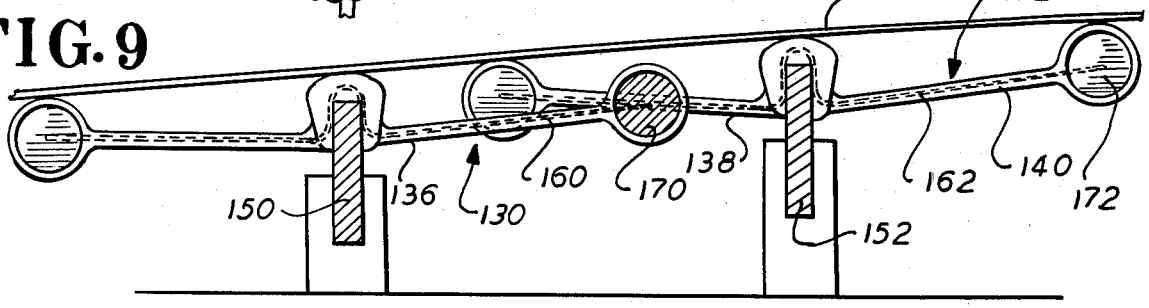
FIG. 9 is an enlarged elevational view similar to FIG. 5 but showing another alternative rapping arm.
Figure 10:
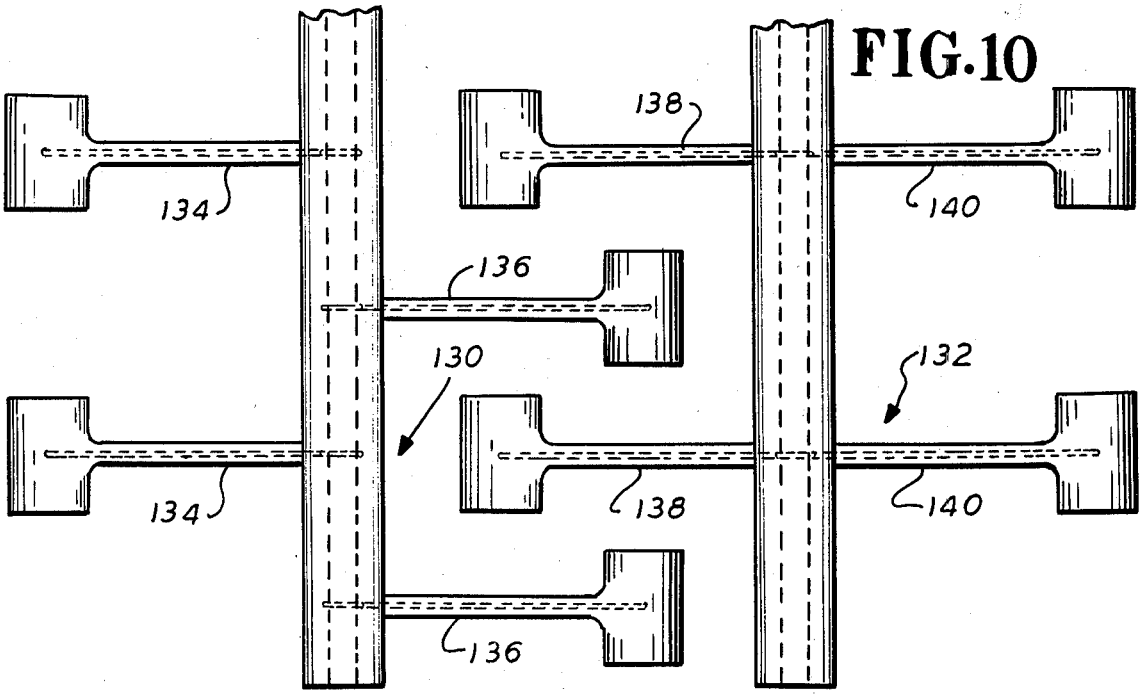
FIG. 10 is a plan view of the alternative rapping arm of FIG. 9.

Further modified forms of rapping arm assemblies 130, 132, are shown in FIGS. 9 and 10. In this embodiment rapping arm assembly 130 includes springy arms 134,136 extending to each side thereof; but with springy arms 134 offset in the longitudinal direction from springy arms 136. Rapping arm assembly 132 includes springy arms 138,140 that are co-linear. Rapping arms 130,132 are each shown extending the entire length of their respective support bars 150,152; but may just as easily be formed in selected lengths, shorter than the overall length of support bars 150,152, with an appropriate number of rapping arm assemblies 130,132 disposed on top of support bars 150,152 to fill the entire length thereof.

Each rapping arm assembly 130,132 is cast about a leaf type spring 160,162 respectively to facilitate imparting a spring action thereto; and includes a weight 170,172 of suitable size, weight and configuration to impart the desired rapping action against the underside of screen deck 180.

While the weights 92,94, and the apertures for receiving same 170,172 have been shown to be of cylindrical configuration other suitable configurations (such as square, hexagonal, etc.) will also do. In addition these weights may be provided by cutting off lengths of bar stock of corresponding cross-section to the appropriate length.

From the above description it will thus be seen that there has been provided a novel and improved vibrating screen and screen deck unclogging mechanism therefore; which screen and unclogging mechanism incorporate simple, efficient and effective means for inducing a rapping action against the underside of a screen deck to loosen material lodged in the screen deck openings.

It is understood that although I have shown the preferred forms of my invention that various modifications may be made in the details thereof without departing from the spirit as comprehended by the following claims.

I claim:

1. A screen deck unclogging mechanism; comprising:

(a) mounting means formed to be supported beneath and to aid in the support of a screen deck when disposed in proximity to the screen deck;

(b) arm means formed integral with and extending laterally to at least one side of said mounting means and so as to have a free end spaced from said mounting means;

(c) weight means disposed at said free end of said arm means;

(d) said arm means including an integrally formed springy section disposed between said mounting means and said free end; and (e) the coaction between said weight means and said springy section of said arm means being such that when said mounting means is disposed beneath and in proximity to a screen deck and the screen deck is vibrated said weight means will rap against the underside of the screen deck to loosen material which may be lodged in the openings of the screen deck.

2. The mechanism of claim 1, wherein said arm means extend to both sides of said mounting means.

3. The mechanism of claim 2, wherein said arm means on one side of said mounting means is offset with respect to said arm means on the other side of said mounting means.

4. The mechanism of claim 2, wherein there are a plurality of arm means on each side of said mounting means.

5. The mechanism of claim 1, wherein said mounting means, arm means, and springy section are cast from rubber or other resiliant plastic material.

6. The mechanism of claim 5, wherein said free ends of said arm means is formed with an aperture of predetermined configuration and so as to receive said weight means.

7. The mechanism of claim 6, wherein said weight means is formed from metal.

8. The mechanism of claim 7, wherein said weight means and said aperture are of cylindrical configuration.

9. The mechanism of claim 8, including a leaf-like metal strip integrally cast into said mounting means, arm means, and springy section.

10. The mechanism of claim 5, wherein said weight means is cast integral with and of the same material as said mounting means and said arm means.

11. The mechanism of claim 1, wherein said mounting means includes a longitudinal groove formed to fit on top of a screen deck support bar.

12. A vibrating screen; comprising:

(a) vibrating frame means;

(b) at least one screen deck carried by said vibrating frame means;

(c) vibrator means carried by said vibrating frame means to vibrate same and said screen deck;

(d) screen deck unclogging means disposed beneath and in proximity to said screen deck to coact therewith when said vibrator means vibrates said vibrating frame means and said screen deck to loosen material which may have become lodged in said screen deck; and (e) said screen deck unclogging means; including:

(1) mounting means formed to be supported beneath and to aid in the support of said screen deck and so as to support said unclogging means in proximity to said screen deck;

(2) arm means formed integral with and extending laterally to at least one side of said mounting means and so as to have a free end spaced from said mounting means;

(3) weight means disposed at said free end of said arm means; and (4) said arm means including an integrally formed springy section disposed between said mounting means and said free end such that when said screen deck means is vibrated said weight means will rap against the underside of said screen deck.

13. The vibrating screen of claim 12, wherein said vibraframe means includes screen deck support means and said mounting means, of said screen deck unclogging means, is sandwiched between said screen deck support means and said screen deck means.

14. The vibrating screen of claim 13, wherein said mounting means includes a groove which fits over said screen deck support means.

15. The vibrating screen of claim 14, wherein said screen deck support means includes a plurality of screen support bars disposed in spaced and substantially parallel relationship to each other and to side walls of said vibrating frame means; and there is at least one screen deck unclogging means disposed on top of each of said screen support bars.

16. The vibrating screen of claim 15, wherein there are a plurality of screen deck unclogging means, disposed on top of each of said screen support bars.

17. The vibrating screen of claim 12, wherein said arm means extend to both sides of said mounting means.

18. The vibrating screen of claim 17, wherein said arm means on one side of said mounting means is offset with respect to said arm means on the other side of said mounting means.

19. The vibrating screen of claim 17, wherein there are a plurality of arm means on each side of said mounting means.

20. The vibrating screen of claim 12, wherein said mounting means, arm means, and springy section are cast from rubber or other resilient plastic material.

21. The vibrating screen of claim 20, wherein said free end of said arm means is formed with an aperture of predetermined configuration and so as to receive said weight means.

22. The vibrating screen of claim 21, wherein said weight means is formed from metal.

23. The vibrating screen of claim 22, wherein said weight means and said apertures are of cylindrical configuration.

24. A screen deck unclogging mechanism; comprising:

(a) mounting means formed to be supported beneath and in proximity to a screen deck;

(b) arm means formed integral with and extending laterally to at least one side of said mounting means and so as to have a free end spaced from said mounting means;

(c) weight means disposed at said free end of said arm means; and (d) said arm means including an integrally formed springy section disposed between said mounting means and said free end;

(e) the coaction between said weight means and said springy section of said arm means being such that when said mounting means is disposed beneath and in proximity to a screen deck and the screen deck is vibrated said weight means will rap against the underside of the screen deck to loosen material which may be lodged in the openings of the screen deck;

(f) said mounting means, arm means, and springy section being cast from rubber or other resilient plastic material;

(g) said weight means being cast integral with and of the same material as said mounting means and said arm means.

25. A vibrating screen; comprising:

(a) vibrating frame means;

(b) said vibrating frame means including screen deck support means;

(c) at least one screen deck carried by said vibrating frame means;

(d) vibrator means carried by said vibrating frame means to vibrate same and said screen deck;

(e) screen deck unclogging means disposed beneath and in proximity to said screen deck to coact therewith when said vibrator means vibrates said vibrating frame means and said screen deck to loosen material which may have become lodged in said screen deck; and (f) said screen deck unclogging means: including:

(1) mounting means sandwiched between said screen deck support means and said screen deck means and so as to support said unclogging means in proximity to said screen deck;

(2) arm means formed integral with and extending laterally to at least one side of said mounting means and so as to have a free end spaced from said mounting means;

(3) weight means disposed at said free end of said arm means; and (4) said arm means including an integrally formed springy section section disposed between said mounting means and said free end such that when said screen deck means is vibrated said weight means will rap against the underside of said screen deck.

26. The vibrating screen of claim 25, wherein said mounting means includes a groove which fits over said screen deck support means.

27. The vibrating screen of claim 26, wherein said screen deck support means includes a plurality of screen support bars disposed in spaced and substantially parallel relationship to each other and to side walls of said vibrating frame means; and there is at least one screen deck unclogging means disposed on top of each of said screen support bars.

28. The vibrating screen of claim 27, wherein there are a plurality of screen deck unclogging means, disposed on top of each of said screen support bars.

29. The vibrating screen of claim 25, wherein said arm means extend to both sides of said mounting means.

30. The vibrating screen of claim 29, wherein said arm means on one side of said mounting means is offset with respect to said arm means on the other side of said mounting means.

31. The vibrating screen of claim 29, wherein there are a plurality of arm means on each side of said mounting means.

32. The vibrating screen of claim 25, wherein said mounting means, arm means, and springy section are cast from rubber or other resilient plastic material; and said free end of said arm means is formed with an aperture of predetermined configuration and so as to receive said weight means.

33. The vibrating screen of claim 32, wherein said weight means is formed from metal.

34. The vibrating screen of claim 33, wherein said weight means and said apertures are of cylindrical configuration.

* * * * *